US009254015B2

(12) United States Patent
Nugent

(10) Patent No.: US 9,254,015 B2
(45) Date of Patent: Feb. 9, 2016

(54) NON-GAITER BOOTLEG COVER

(76) Inventor: Samantha Nugent, West Chester, PA (US)

( * ) Notice: Subject to any disclaimer, the term of this patent is extended or adjusted under 35 U.S.C. 154(b) by 571 days.

(21) Appl. No.: 13/373,697

(22) Filed: Nov. 25, 2011

(65) Prior Publication Data

US 2013/0133228 A1 May 30, 2013

(51) Int. Cl.

| | |
|---|---|
| ***A43B 23/02*** | (2006.01) |
| ***A43B 3/00*** | (2006.01) |
| ***A41D 17/00*** | (2006.01) |
| ***A41D 13/00*** | (2006.01) |
| ***A41D 17/02*** | (2006.01) |
| ***A41B 11/00*** | (2006.01) |
| ***A43B 3/20*** | (2006.01) |
| ***A43C 11/06*** | (2006.01) |
| ***A43C 11/04*** | (2006.01) |
| ***A43C 11/02*** | (2006.01) |
| ***A43C 11/08*** | (2006.01) |
| ***A43B 23/24*** | (2006.01) |

(52) U.S. Cl.

CPC . *A43B 3/20* (2013.01); *A43B 23/24* (2013.01); *A43C 11/02* (2013.01); *A43C 11/04* (2013.01); *A43C 11/06* (2013.01); *A43C 11/08* (2013.01)

(58) Field of Classification Search

CPC ..... A43B 3/16; A43B 3/18; A43C 11/00; A43C 11/02; A43C 11/04; A43C 11/06; A43C 11/08

USPC ..... 2/22, 61, 240, 242; 36/109, 1.5, 7.1 R, 36/2 R; D2/901, 909

See application file for complete search history.

(56) References Cited

U.S. PATENT DOCUMENTS 487,226 A * 11/1892 McGuigan ..... A41D 17/00 36/2 R
562,784 A * 6/1896 Fisher ..... A41D 17/00 2/232
D27,005 S * 4/1897 Armstrong ..... D2/901
625,423 A * 5/1899 Scriven ..... A41B 9/04 2/401
1,286,198 A * 12/1918 Ascheim ..... A41D 17/00 36/2 R
1,368,771 A * 2/1921 Tweedie ..... A41D 17/00 36/2 R
1,442,392 A * 1/1923 Gantenbein ..... A43B 3/02 36/1.5
1,527,825 A * 2/1925 Baggerud ..... A41D 3/06 2/231
1,708,144 A * 4/1929 Martin ..... A41D 17/00 2/61
1,722,918 A * 7/1929 Hohein ..... A41B 11/00 2/242
2,416,944 A * 3/1947 Norlin ..... A43B 3/166 36/70 R
3,012,343 A 12/1961 Dinkle ..... 36/7.2
3,027,660 A 4/1962 Werner ..... 36/7.1 R
3,083,373 A * 4/1963 Rizzotto ..... A41D 17/00 2/227
3,087,260 A 4/1963 Hudon ..... 36/7.2
3,613,681 A * 10/1971 Adams ..... A61F 13/06 602/60

(Continued)

*Primary Examiner* — Clinton T Ostrup
*Assistant Examiner* — Cameron A Carter
(74) *Attorney, Agent, or Firm* — Bernard S. Hoffman

(57) ABSTRACT

A universal, readily interchangeable, and non-gaiter cover for wrapping around and decorating only the shaft of an any sized and mundane boot. The universal, readily interchangeable, and non-gaiter cover includes a decorative substrate, and apparatus for universally and readily interchangeably maintaining the decorative substrate around only the shaft of the any sized and mundane boot. The decorative substrate is for universally and readily interchangeably wrapping around only the shaft of the any sized and mundane boot and not the foot of the any sized and mundane boot so as to at least eliminate potential damage to the universal, readily interchangeable, and non-gaiter cover caused by normal flexure of the foot of the any sized and mundane boot, and in so doing, decorates only the shaft of the any sized and mundane boot.

7 Claims, 7 Drawing Sheets

(56) References Cited

U.S. PATENT DOCUMENTS 3,820,254 A 6/1974 Kopacsi ..... 36/110
3,965,586 A 6/1976 Roosli ..... 36/7.3
4,168,584 A 9/1979 Wren, Jr. et al. ..... 36/2 R
4,361,912 A 12/1982 Arthur ..... 2/18
4,382,301 A * 5/1983 Hightower, Jr. ..... A41D 17/00 2/2.5
4,445,287 A 5/1984 Garcia ..... 36/106
4,586,272 A * 5/1986 Forster ..... A41D 17/00 36/2 A
RE32,506 E * 9/1987 Hightower, Jr. ..... A41D 17/00 2/2.5
5,031,247 A * 7/1991 Carter ..... A41D 13/0543 2/22
5,170,503 A * 12/1992 Hightower, Jr. ..... A41D 17/02 2/22
5,173,967 A * 12/1992 Carter ..... A41D 13/0543 2/16
D343,043 S 1/1994 Campbell ..... D2/897
5,501,022 A * 3/1996 Cohn ..... A41D 17/00 36/100
D369,455 S * 5/1996 Halvorson ..... D2/901
5,642,573 A * 7/1997 Brown ..... A41D 17/00 36/132
5,729,915 A * 3/1998 Khoo ..... A43B 3/16 36/7.1 R
5,740,559 A * 4/1998 Thiel ..... A41B 11/00 2/239
5,784,806 A * 7/1998 Wendt ..... A43B 3/02 36/2 R
D396,740 S * 8/1998 Magliulo ..... D2/901
5,815,948 A * 10/1998 Dzielak ..... A41D 17/00 2/22
5,887,359 A * 3/1999 Falguere ..... 36/2 R
6,127,022 A 10/2000 Pretorius ..... 428/195.1
6,457,260 B1 * 10/2002 Roelofs ..... A41D 17/00 2/23
6,477,788 B1 11/2002 Chen ..... 36/1.5
D505,777 S * 6/2005 Dunlap ..... D2/901
7,069,670 B1 * 7/2006 Gerke ..... A41D 17/00 2/22
D546,529 S * 7/2007 Myskiw ..... D2/901
8,510,972 B2 * 8/2013 Bizzo ..... A43B 3/02 36/1.5
2002/0174565 A1 * 11/2002 Roelofs ..... A41D 17/00 36/2 R
2003/0097765 A1 * 5/2003 Chen ..... A43B 3/166 36/2 R
2005/0188561 A1 * 9/2005 Fine ..... A41D 17/00 36/2 R
2006/0117598 A1 * 6/2006 Czaplewski ..... A41D 17/00 36/2 R
2007/0044343 A1 * 3/2007 Harris ..... A43B 3/163 36/7.1 R
2007/0277291 A1 * 12/2007 McCarron ..... A41D 17/00 2/242
2008/0155863 A1 * 7/2008 Shor ..... A41D 17/00 36/2 R
2008/0184458 A1 * 8/2008 Moeszinger ..... A41B 11/00 2/239
2009/0049710 A1 * 2/2009 Barnett ..... A41D 15/00 36/1.5
2009/0090024 A1 * 4/2009 Phlawadana ..... A41D 17/00 36/1.5
2009/0241380 A1 * 10/2009 Jeffers ..... A43B 3/0078 36/136
2011/0067159 A1 * 3/2011 Smith ..... A41D 1/08 2/22
2011/0162237 A1 * 7/2011 Jeffers ..... A43B 3/0078 36/136
2011/0239487 A1 * 10/2011 Renkes ..... A43B 3/02 36/136
2013/0000155 A1 * 1/2013 Romer ..... A43B 3/16 36/136
2014/0041260 A1 2/2014 Jewell et al. ..... 36/2 R

* cited by examiner

NON-GAITER BOOTLEG COVER

1. BACKGROUND OF THE INVENTION

A. Field of the Invention

The embodiments of the present invention relate to a cover for a boot, and more particularly, the embodiments of the present invention relate to a universal, readily interchangeable, and non-gaiter cover for wrapping around and decorating only the shaft of an any sized and mundane boot and not the foot of the any sized and mundane boot so as to at least eliminate potential damage to the universal, readily interchangeable, and non-gaiter cover caused by normal flexure of the foot of the any sized and mundane boot.

B. Description of the Prior Art

Numerous innovations for foot-wear coverings have been provided in the prior art, which will be described below in chronological order to show advancement in the art, and which are incorporated herein by reference thereto. Even though these innovations may be suitable for the specific individual purposes to which they address, nevertheless, they differ from the embodiments of the present invention in that they do not teach a universal, readily interchangeable, and non-gaiter cover for wrapping around and decorating only the shaft of an any sized and mundane boot and not the foot of the any sized and mundane boot so as to at least eliminate potential damage to the universal, readily interchangeable, and non-gaiter cover caused by normal flexure of the foot of the any sized and mundane boot.

(1) U.S. Pat. No. 562,784 to Fisher

U.S. Pat. No. 562,784—issued to Fisher on Jun. 23, 1896 in U.S. class 36 and subclass 2R—teaches a legging for gentleman's wear. The legging includes a legging-body, tongues or strips attached to the inside of the legging-body at points above the bottom edge of the legging and adapted to engage the turned-up bottom of the trousers, and apparatus for fastening the edges of the legging-body together.

(2) U.S. Pat. No. 3,012,343 to Dinkle

U.S. Pat. No. 3,012,343—issued to Dinkle on Dec. 12, 1961 in U.S. class 36 and subclass 7.2—teaches a sole protector for bowling shoes, which includes a single hexagonally shaped piece of synthetic resin material having three arcuate-shaped sides spaced from each other by three straight sides. The material is dimensioned to cover the sole of a bowling shoe, from adjacent the breast of the heel of the shoe substantially to the toe thereof. Apparatus interconnects two of the straight sides across the toe of the bowling shoe. An elastic heel strap is connected, at its ends, to opposite ends of the third straight side of the material and cooperates with the apparatus that interconnects two of the straight sides to retain the sole protector in place over the side of the bowling shoe.

(3) U.S. Pat. No. 3,027,660 to Werner

U.S. Pat. No. 3,027,660—issued to Werner on Apr. 3, 1962 in U.S. class 36 and subclass 7.1R—teaches a wrap-around overshoe for a skater's shoe, which includes a relatively thick sole portion and an upper secured to the sole portion. The upper is formed of a material of relatively greater flexibility than the sole portion. The upper includes a forward portion and a pair of side portions to be wrapped around a skating shoe after the forward portion thereof has been positioned on the forward end of the skating shoe. A progressively engageable slide fastening apparatus is on each of the opposed free ends of the wrap-around portion. Apparatus is on the top of the fastening apparatus to initially engage the top ends of the fastening apparatus. Actuator apparatus is on the fastening apparatus to progressively engage the fastening apparatus by movement of the actuating apparatus from the top to the bottom of the upper. The fastening apparatus terminates at the thickened sole portion, whereby when the fastening apparatus is closed and the overshoe is in use, the actuator apparatus is in a position substantially free of strains tending to force undesirable movement from the fastened position.

(4) U.S. Pat. No. 3,083,373 to Rizzotto

U.S. Pat. No. 3,083,373—issued to Rizzotto on Apr. 2, 1963 in U.S. class 2 and subclass 270—teaches wearing apparel that includes a garment leg, a first elastic anklet provided at the lower end of the garment leg and positionably juxtaposed to the top of a shoe, a sleeve-like protector superposed on the lower end portion of the garment leg, circumferential slide fastener apparatus separately connecting the upper edge of the protector to the garment leg in a plane spaced above the anklet, and a second elastic anklet provided at the lower edge of the protector. The second elastic anklet encloses the first elastic anklet, and is adapted to overlap the shoe. The protector and the second elastic anklet are longitudinally split. Slide fastener apparatus separately secures together the longitudinally split edges of the protector and the second elastic anklet.

(5) U.S. Pat. No. 3,087,260 to Hudon

U.S. Pat. No. 3,087,260—issued to Hudon on Apr. 30, 1963 in U.S. class 36 and subclass 7.2—teaches a leg protector for protecting a lower leg and foot of a wearer during inclement weather. The leg protector includes a gaiter having an elongated, wide, and contoured body with substantially straight side margins. The gaiter fits snugly around the lower leg of the wearer, between the knee and the ankle. Slide fastener apparatus connects together the margins of the gaiter at the side of the lower leg of the wearer. An ankle piece is integral with the bottom of the gaiter, and extends forwardly a distance therefrom to cover the instep of the wearer. The bottom rear portion of the gaiter extends downwardly on the heel of the wearer to a level below the ankle piece. A sandal fits over the foot of the wearer. The sandal has an opening at the rear of the sole, and a heel portion constitutes a strap that supports the sandal on the foot of the wearer. The heel portion extends upwardly on the foot of the wearer and under the bottom of the gaiter. Slide fastener apparatus connects a front upper marginal portion of the sandal to the margin of the ankle piece. A sole strap is connected, at one end thereof, to one side of the gaiter. The sole strap girts the underside of the sandal. The other end of the sole strap has a snap fastener that secures the sole strap to the gaiter, at the side opposite the first-mentioned side.

(6) U.S. Pat. No. 3,613,681 to Adams

U.S. Pat. No. 3,613,681—issued to Adams on Oct. 19, 1971 in U.S. class 602 and subclass 60—teaches a therapeutic aid including a closed cell, resilient, and foamed elastomeric sheath dimensioned to be received in circumscribing relation about an afflicted body area. The elastomer is not more than about one-fourth inch thick and forms an effective thermal and moisture barrier between the afflicted body and ambient atmosphere. Inner and outer isotonic surfaces are integrally bonded to and cover substantially the entire inner and outer surfaces of the elastomer sheath. The isotonic surface coverings are substantially equally tensioned with respect to each other, and substantially tensioned with respect to the elastomer sheath.

(7) U.S. Pat. No. 3,820,254 to Kopacsi

U.S. Pat. No. 3,820,254—issued to Kopacsi on Jun. 28, 1974 in U.S. class 36 and subclass 110—teaches a foot-cast shoe-type cover for covering a foot encased in a cast. The cover includes a sock-type foot-cover of stretchable waterproof material having a sole part. A shoe-type sole and a heel accommodating holes are provided on the sole part of the foot cover.

(8) U.S. Pat. No. 3,965,586 to Roosli

U.S. Pat. No. 3,965,586—issued to Roosli on Jun. 29, 1976 in U.S. class 36 and subclass 7.3—teaches a ski boot sole covering assembly that is specifically shaped for covering and protecting all of the sole surfaces of a ski boot so as to be worn when the skis are not attached, thereby preserving the integrity of the ski binding-engaging surfaces of the boot. The assembly also embodies a sole portion that is thickest in the area intermediate the toe and heel so as to allow a rocking action when walking.

(9) U.S. Pat. No. 4,168,584 to Wren, Jr. et al

U.S. Pat. No. 4,168,584—issued to Wren, Jr. et al. on Sep. 25, 1979 in U.S. class 36 and subclass 2R—teaches a foot protector including a front portion providing a protective cover for the toes and instep of the wearer, and a wrap-around rear portion protecting the back and ankle portions of the foot. The protector is fully open at the bottom. The rear portion of the protector includes oppositely disposed sides, and is formed into separable portions that are provided with lace openings so that they can be laced together by a single lace. The lace includes a side lace portion that draws the sides together, and a transverse portion that extends under the foot and cooperates with the side lacing to secure the protector to the foot. Reinforcing strips are provided to strengthen the lace margins and the junction between the front and rear portions of the shoe.

(10) U.S. Pat. No. 4,361,912 to Arthur

U.S. Pat. No. 4,361,912—issued to Arthur on Dec. 7, 1982 in U.S. class 2 and subclass 18—teaches karate protective equipment including a glove, a boot, and a shinguard, and which is formed of an outer soft foam material and selectively positioned harder inner foam layers for added protection.

(11) U.S. Pat. No. 4,445,287 to Garcia

U.S. Pat. No. 4,445,287—issued to Garcia on May 1, 1984 in U.S. class 36 and subclass 106—teaches a releasably attachable insulative covering for a skate shoe. The covering includes a covering panel for enveloping the skate shoe and for being fabricated from thermally insulative material. The panel includes a toe-covering portion, a heel-covering portion, and an in-step covering portion therebetween, with flexible fastening apparatus releasably attaching the covering panel to the skate shoe. The flexible fastening apparatus includes a plurality of mating interconnecting pairs of hooks and loops, which are mounted on the covering panel, with one mating pair being secured generally vertically along the rear portion of the panel to form a heel closure, and with another mating pair being secured as cross-strap tab fasteners for coupling generally transversely across the undersurface of the arch portion of the skate shoe.

(12) U.S. Pat. No. Des. 343,043 to Campbell

U.S. Pat. No. Des. 343,043—issued to Campbell on Jan. 11, 1994 in U.S. class D2 and subclass 897—teaches the ornamental design for a disposable shoe and boot cover.

(13) U.S. Pat. No. 5,501,022 to Cohn

U.S. Pat. No. 5,501,022—issued to Cohn on Mar. 26, 1996 in U.S. class 36 and subclass 2R—teaches a decorative boot having interchangeable tubular decorative components adapted to lie substantially smoothly on the outer surface of the boot between the top of the boot and the ankle portion so as to leave the heel and toe portions uncovered.

(14) U.S. Pat. No. Des. 396,740 to Magliulo

U.S. Pat. No. Des. 396,740—issued to Magliulo on Aug. 11, 1998 in U.S. class D2 and subclass 901—teaches the ornamental design for a conversion boot upper.

(15) U.S. Pat. No. 5,887,359 to Falguere

U.S. Pat. No. 5,887,359—issued to Falguere on Mar. 30, 1999 in U.S. class 36 and subclass 2R—teaches a water-proof protective gaiter for a boot, which has a tubular shape. The gaiter includes a lower portion covering at least partially the upper of the boot in a front area of insertion of the user's foot, and whose lower end circumference is designed to adopt the contour of the upper. An upper portion is designed to enclose the lower leg of the user. An at least partially peripheral flap, forming an extension of the circumference, extends from at least a portion of the end circumference of the lower portion of the gaiter, so as to extend the range of protection of the gaiter beyond the circumference.

(16) U.S. Pat. No. 6,127,022 to Pretorius

U.S. Pat. No. 6,127,022—issued to Pretorius on Oct. 3, 2000 in U.S. class 428 and subclass 195.1—teaches a camouflage surface for concealment from, and deception of, a herbivorous animal, which includes a camouflage pattern made up of at least two different types of regions that reflect electromagnetic radiation in the near-infra-red range of the electromagnetic spectrum. All the regions of each type reflect the near-infra-red radiation in the same fashion as one another, and in a fashion different from the fashion in which the regions of each other type reflect the radiation. The different types of regions all have, in the near-infra-red range, spectral reflectance curves with reflectance maxima at wavelengths of at least 680 nm. Each spectral reflectance curve that the surface has in the visible light range of the electromagnetic spectrum is without a reflectance maximum in the wavelength range between 480 and 680 nm, and each spectral reflectance curve that the surface has in the visible light range has a reflectance maximum at a wavelength of at most 480 nm.

(17) U.S. Pat. No. 6,477,788 to Chen

U.S. Pat. No. 6,477,788—issued to Chen on Nov. 12, 2002 in U.S. class 36 and subclass 1.5—teaches a shoe including an upper with a gaiter having a top end, a bottom end, and two opposite lateral sides interconnecting the top and bottom ends. The gaiter further includes, adjacent to the lateral sides thereof, fasteners to engage one another so as to place the gaiter in a closed position. A zipper has a first zipper strap attached to an inner surface of the gaiter, between the lateral sides, and between the top and bottom ends of the gaiter, and spaced from the bottom end of the gaiter. A second zipper strap to complement with the first zipper strap is attached to the upper, adjacent to the top end of the upper.

(18) U.S. Pat. No. Des. 505,777 to Dunlap

U.S. Pat. No. Des. 505,777—issued to Dunlap on Jun. 7, 2005 in U.S. class D2 and subclass 901—teaches the ornamental design for a shoe sleeve.

It is apparent that numerous innovations for foot-wear coverings have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a universal, readily interchangeable, and non-gaiter cover for wrapping around and decorating only the shaft of an any sized and mundane boot and not the foot of the any sized and mundane boot so as to at least eliminate potential damage to the universal, readily interchangeable, and non-gaiter cover caused by normal flexure of the foot of the any sized and mundane boot.

2. SUMMARY OF THE INVENTION

Thus, an object of the embodiments of the present invention is to provide a universal, readily interchangeable, and non-gaiter cover for wrapping around and decorating only the shaft of an any sized and mundane boot and not the foot of the any sized and mundane boot so as to at least eliminate potential damage to the universal, readily interchangeable, and non-gaiter cover caused by normal flexure of the foot of the any sized and mundane boot, which avoids the disadvantages of the prior art.

Briefly stated, another object of the embodiments of the present invention is to provide a universal, readily interchangeable, and non-gaiter cover for wrapping around and decorating only the shaft of an any sized and mundane boot and not the foot of the any sized and mundane boot so as to at least eliminate potential damage to the universal, readily interchangeable, and non-gaiter cover caused by normal flexure of the foot of the any sized and mundane boot. The universal, readily interchangeable, and non-gaiter cover includes a decorative substrate, and apparatus for universally and readily interchangeably maintaining the decorative substrate around only the shaft of the any sized and mundane boot and not the foot of the any sized and mundane boot so as to at least eliminate potential damage to the universal, readily interchangeable, and non-gaiter cover caused by normal flexure of the foot of the any sized and mundane boot. The decorative substrate is for universally and readily interchangeably wrapping around only the shaft of the any sized and mundane boot and not the foot of the any sized and mundane boot so as to at least eliminate potential damage to the universal, readily interchangeable, and non-gaiter cover caused by normal flexure of the foot of the any sized and mundane boot, and in so doing, decorates only the shaft of the any sized and mundane boot.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows:

FIG. 1 is a diagrammatic perspective view of the universal, readily interchangeable, and non-gaiter cover wrapping around and decorating only the shaft of an any sized and mundane boot and not the foot of the any sized and mundane boot so as to at least eliminate potential damage to the universal, readily interchangeable, and non-gaiter cover caused by normal flexure of the foot of the any sized and mundane boot;

FIG. 2 is an exploded diagrammatic perspective view of the universal, readily interchangeable, and non-gaiter cover wrapping around and decorating only the shaft of an any sized and mundane boot and not the foot of the any sized and mundane boot so as to at least eliminate potential damage to the universal, readily interchangeable, and non-gaiter cover caused by normal flexure of the foot of the any sized and mundane boot;

Figure 1:
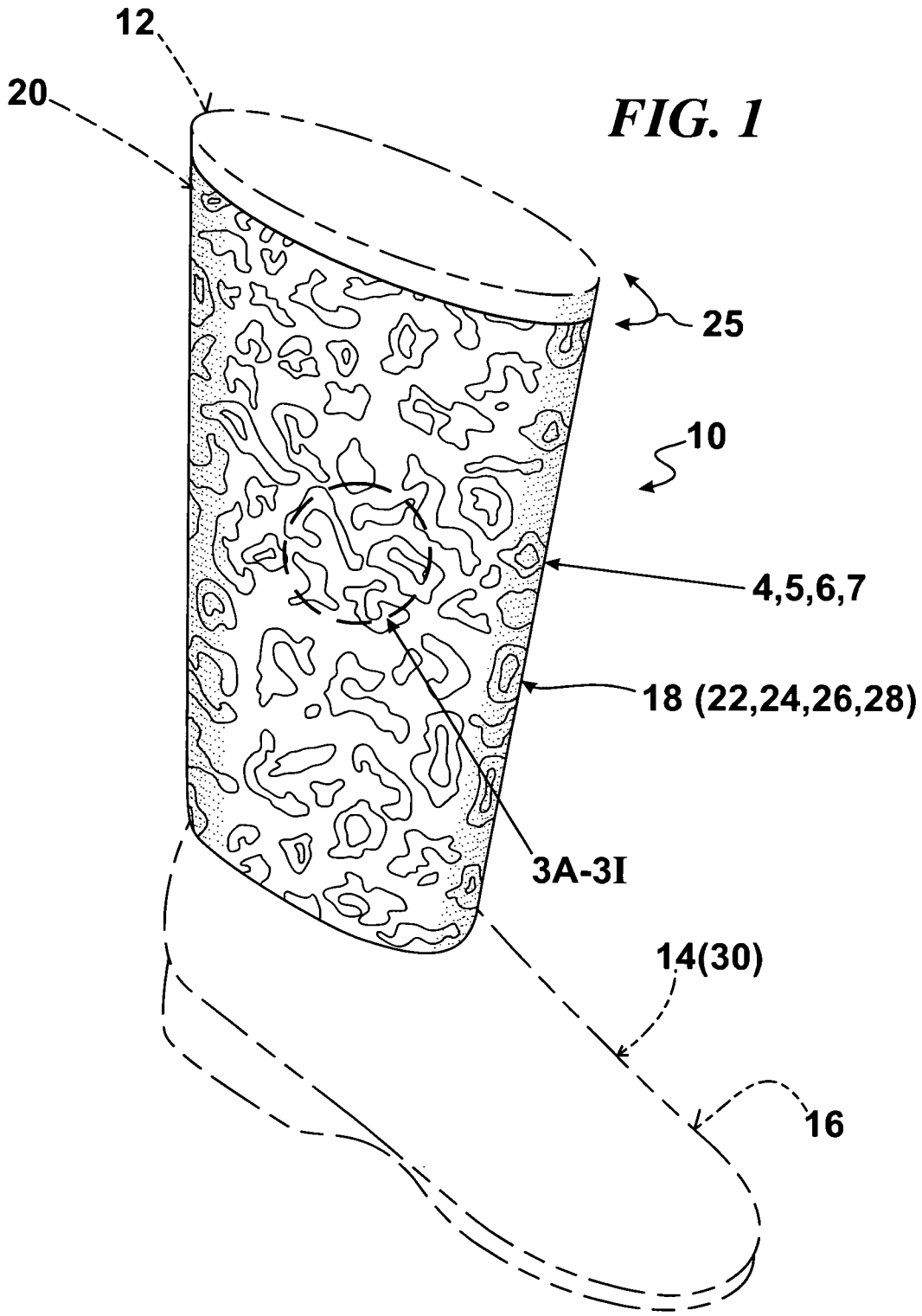
Figure 2:
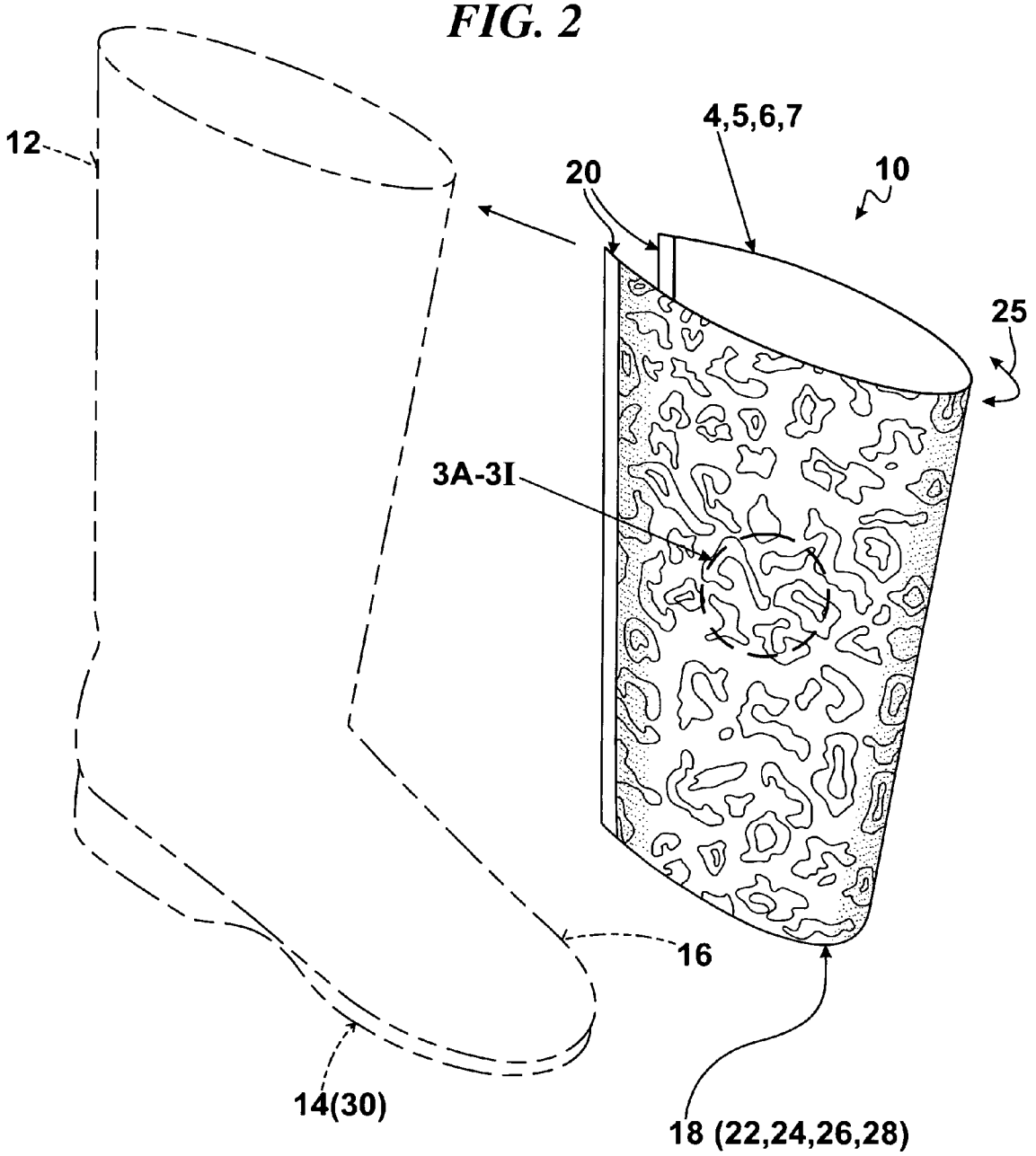
Figure 3A:
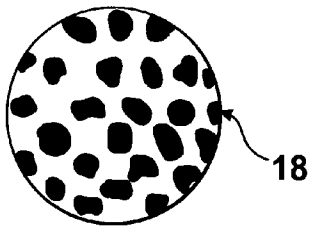
FIGS. 3A-3I are a sampling of snapshots of the area generally enclosed by the dotted curve identified by ARROW 3A-3I in FIGS. 1 and 2 of different pattens of the decorative substrate, which are merely illustrative, exemplary, and not all inclusive.
Figure 3B:
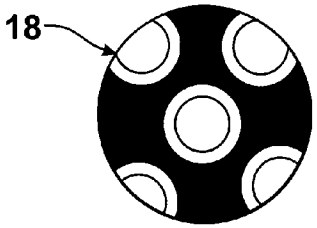
Figure 3C:
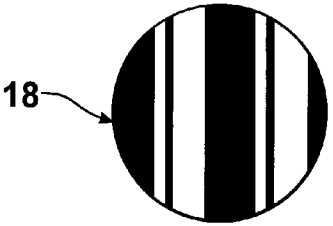
Figure 3D:
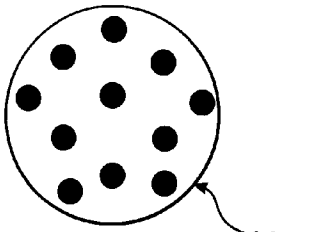
Figure 3E:
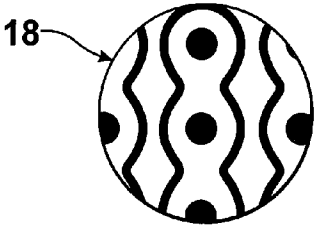
Figure 3F:
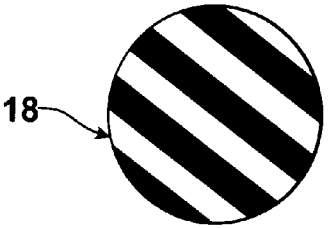
Figure 3G:
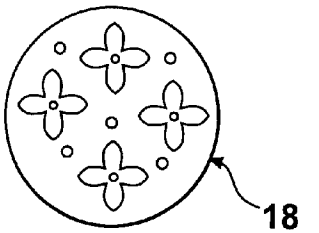
Figure 3H:
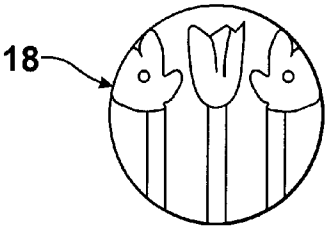
Figure 3I:
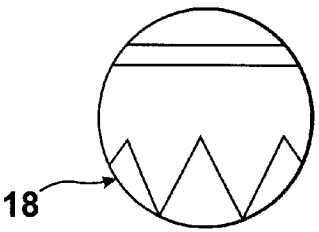
Figure 6:
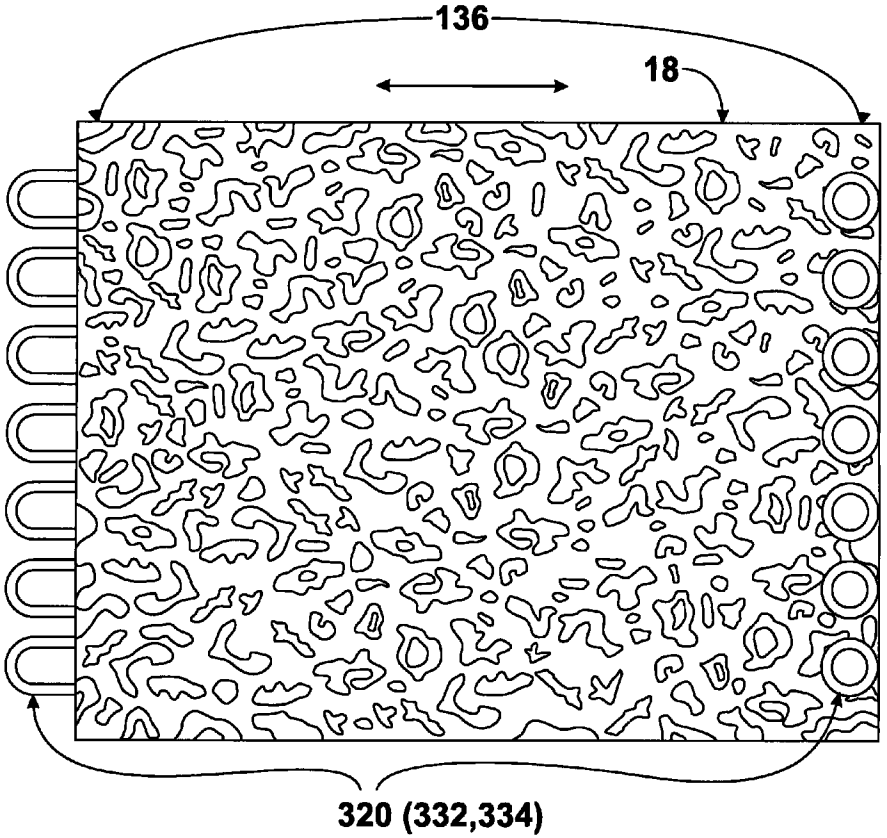
Figure 7:
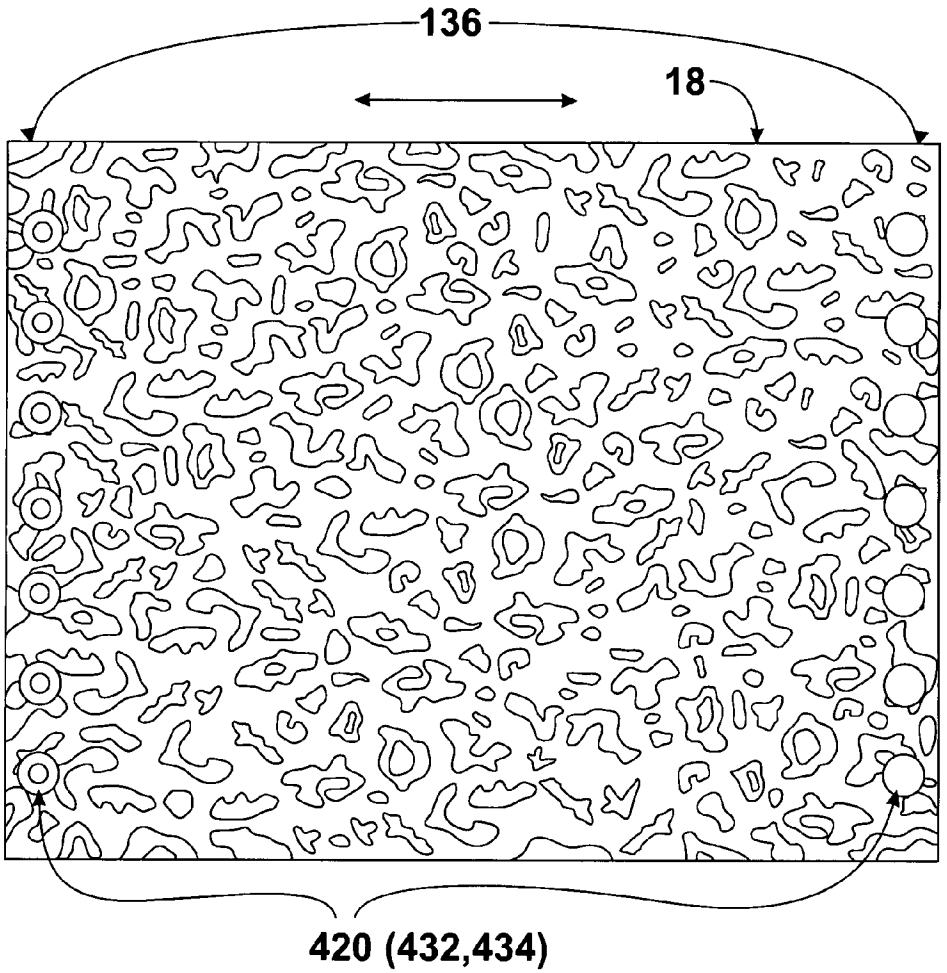

FIG. 6 is a diagrammatic side elevational view of the universal, readily interchangeable, and non-gaiter cover of the embodiments of the present invention identified by ARROW 6 in FIGS. 1 and 2, with a third embodiment of the fastening apparatus being decorative buttons and cooperating loops; and FIG. 7 is a diagrammatic side elevational view of the universal, readily interchangeable, and non-gaiter cover of the embodiments of the present invention identified by ARROW 7 in FIGS. 1 and 2, with a fourth embodiment of the fastening apparatus being decorative snaps.

4. LIST OF REFERENCE NUMERALS UTILIZED IN THE FIGURES OF THE DRAWING

A. General

10 universal, readily interchangeable, and non-gaiter cover of embodiments of present invention for wrapping around and decorating only shaft 12 of any sized and mundane boot 14 and not foot 16 of any sized and mundane boot 14 so as to at least eliminate potential damage to universal, readily interchangeable, and non-gaiter cover 10 caused by normal flexure of foot 16 of any sized and mundane boot 14

12 shaft of any sized and mundane boot 14
14 any sized and mundane boot
16 foot of any sized and mundane boot 14

B. Configuration of Universal, Readily Interchangeable, and Non-Gaiter Cover 10

18 decorative substrate for universally and readily interchangeably wrapping around only shaft 12 of any sized and mundane boot 14 and not foot 16 of any sized and mundane boot 14 so as to at least eliminate potential damage to universal, readily interchangeable, and non-gaiter cover 10 caused by normal flexure of foot 16 of any sized and mundane boot 14, and in so doing, decorates only shaft 12 of any sized and mundane boot 14
20 apparatus for universally and readily interchangeably maintaining decorative substrate 18 around only shaft 12 of any sized and mundane boot 14 and not foot 16 of any sized and mundane boot 14 so as to at least eliminate potential damage to universal, readily interchangeable, and non-gaiter cover 10 caused by normal flexure of foot 16 of any sized and mundane boot 14

(1) Decorative Substrate 18

22 elastic and decorative substrate of decorative substrate 18
24 unidirectional elastic and decorative substrate of elastic and decorative substrate 22 of decorative substrate 18
25 arrows (2) First Embodiment of Apparatus 120

120 apparatus
132 hook and loop fasteners of apparatus 120
134 pair of cooperating hook and loop parts of hook and loop fasteners 132 of apparatus 120
136 free axial edges of decorative substrate 18

(3) Second Embodiment of Apparatus 220

220 apparatus
232 decorative zipper of apparatus 220
234 pair of cooperating decorative zipper parts of decorative zipper 232 of apparatus 220

(4) Third Embodiment of Apparatus 320

320 apparatus
332 decorative button parts of apparatus 320
334 cooperating loop parts of apparatus 320

(5) Fourth Embodiment of Apparatus 420

420 apparatus
432 decorative snaps
434 pair of cooperating decorative snap parts of decorative snaps 432 of apparatus 420

5. DETAILED DESCRIPTION OF THE PREFERRED EMBODIMENTS

A. General

Referring now to the figures, in which like numerals indicate like parts, and particularly to FIGS. 1 and 2, which are, respectively, a diagrammatic perspective view of the universal, readily interchangeable, and non-gaiter cover wrapping around and decorating only the shaft of an any sized and mundane boot and not the foot of the any sized and mundane boot so as to at least eliminate potential damage to the universal, readily interchangeable, and non-gaiter cover caused by normal flexure of the foot of the any sized and mundane boot, and an exploded diagrammatic perspective view of the universal, readily interchangeable, and non-gaiter cover wrapping around and decorating only the shaft of an any sized and mundane boot and not the foot of the any sized and mundane boot so as to at least eliminate potential damage to the universal, readily interchangeable, and non-gaiter cover caused by normal flexure of the foot of the any sized and mundane boot, the universal, readily interchangeable, and non-gaiter cover of the embodiments of the present invention is shown generally at 10 for wrapping around and decorating only the shaft 12 of an any sized and mundane boot 14 and not the foot 16 of the any sized and mundane boot 14 so as to at least eliminate potential damage to the universal, readily interchangeable, and non-gaiter cover 10 caused by normal flexure of the foot 16 of the any sized and mundane boot 14.

B. Configuration of the Universal, Readily Interchangeable, and Non-Gaiter Cover 10

The configuration of the universal, readily interchangeable, and non-gaiter cover 10 can best be seen in FIGS. 1, 2, and 3A-3I, which are, respectively, again, a diagrammatic perspective view of the universal, readily interchangeable, and non-gaiter cover wrapping around and decorating only the shaft of an any sized and mundane boot and not the foot of the any sized and mundane boot so as to at least eliminate potential damage to the universal, readily interchangeable, and non-gaiter cover caused by normal flexure of the foot of the any sized and mundane boot and an exploded diagrammatic perspective view of the universal, readily interchangeable, and non-gaiter cover wrapping around and decorating only the shaft of an any sized and mundane boot and not the foot of the any sized and mundane boot so as to at least eliminate potential damage to the universal, readily interchangeable, and non-gaiter cover caused by normal flexure of the foot of the any sized and mundane boot, and a sampling of snapshots of the area generally enclosed by the dotted curve identified by ARROW 3A-3I in FIGS. 1 and 2 of different pattens of the decorative substrate, which are merely illustrative, exemplary, and not all inclusive, and as such, will be discussed with reference thereto.

The universal, readily interchangeable, and non-gaiter cover 10 comprises a decorative substrate 18, and apparatus 20 for universally and readily interchangeably maintaining the decorative substrate 18 around only the shaft 12 of the any sized and mundane boot 14 and not the foot 16 of the any sized and mundane boot 14 so as to at least eliminate potential damage to the universal, readily interchangeable, and non-gaiter cover 10 caused by normal flexure of the foot 16 of the any sized and mundane boot 14.

(1) Decorative Substrate 18

The decorative substrate 18 is for universally and readily interchangeably wrapping around only the shaft 12 of the any sized and mundane boot 14 and not the foot 16 of the any sized and mundane boot 14 so as to at least eliminate potential damage to the universal, readily interchangeable, and non-gaiter cover 10 caused by normal flexure of the foot 16 of the any sized and mundane boot 14, and in so doing, decorates only the shaft 12 of the any sized and mundane boot 14.

The decorative substrate 18 is an elastic and decorative substrate 22.

The elastic and decorative substrate 22 of the decorative substrate 18 is a unidirectional elastic and decorative substrate 24. The unidirectional elastic and decorative substrate 24 of the elastic and decorative substrate 22 of the decorative substrate 18 is elastic only horizontally and not vertically—as shown by arrows 25—so as to allow the unidirectional elastic and decorative substrate 24 of the elastic and decorative substrate 22 of the decorative substrate 18 to be universal by horizontally stretching to fit smoothly and conformingly around only the shaft 12 of the any sized and mundane boot 14.

The unidirectional elastic and decorative substrate 24 of the elastic and decorative substrate 22 of the decorative substrate 18 is a water-repellent, unidirectional elastic, and decorative substrate 28. The water-repellent, unidirectional elastic, and decorative substrate 28 of the unidirectional elastic and decorative substrate 24 of the elastic and decorative substrate 22 of the decorative substrate 18 is for providing waterproofing when the any sized and mundane boot 14 is an any sized and mundane rain boot 30.

As shown in FIGS. 3A-3I, the patterns for the decorative substrate 18 can be different patterns.

(2) First Embodiment of the Apparatus 120

Figure 4:
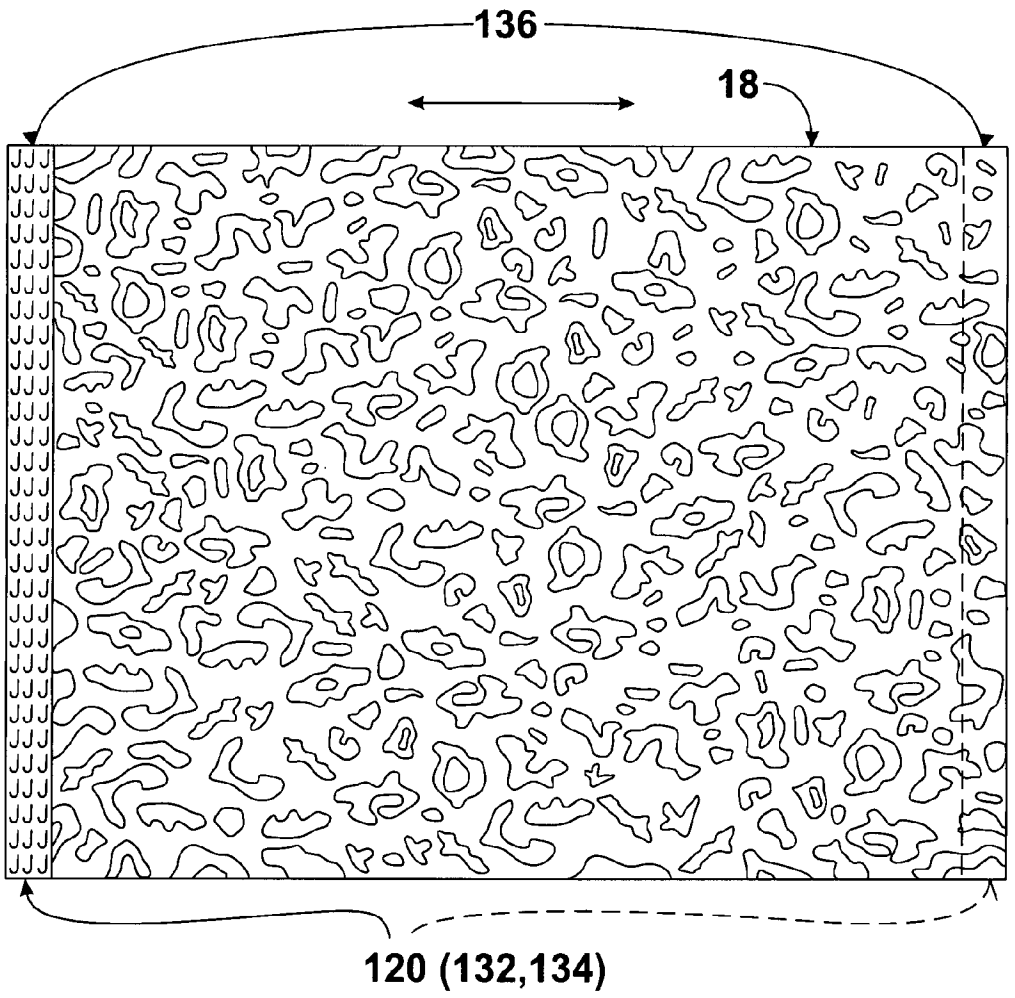
FIG. 4 is a diagrammatic side elevational view of the universal, readily interchangeable, and non-gaiter cover of the embodiments of the present invention identified by ARROW 4 in FIGS. 1 and 2, with a first embodiment of the fastening apparatus being hook and loop fasteners.

The first embodiment of the apparatus 120 can best be seen in FIG. 4, which is a diagrammatic side elevational view of the universal, readily interchangeable, and non-gaiter cover of the embodiments of the present invention identified by ARROW 4 in FIGS. 1 and 2, with a first embodiment of the fastening apparatus being hook and loop fasteners, and as such, will be discussed with reference thereto.

The apparatus 120 includes hook and loop fasteners 132. The hook and loop fasteners 132 of the apparatus 120 has a pair of cooperating hook and loop parts 134. The pair of cooperating hook and loop parts 134 of the hook and loop fasteners 132 of the apparatus 120 are disposed along free axial edges 136 of the decorative substrate 18, respectively.

(3) Second Embodiment of the Apparatus 220

Figure 5:
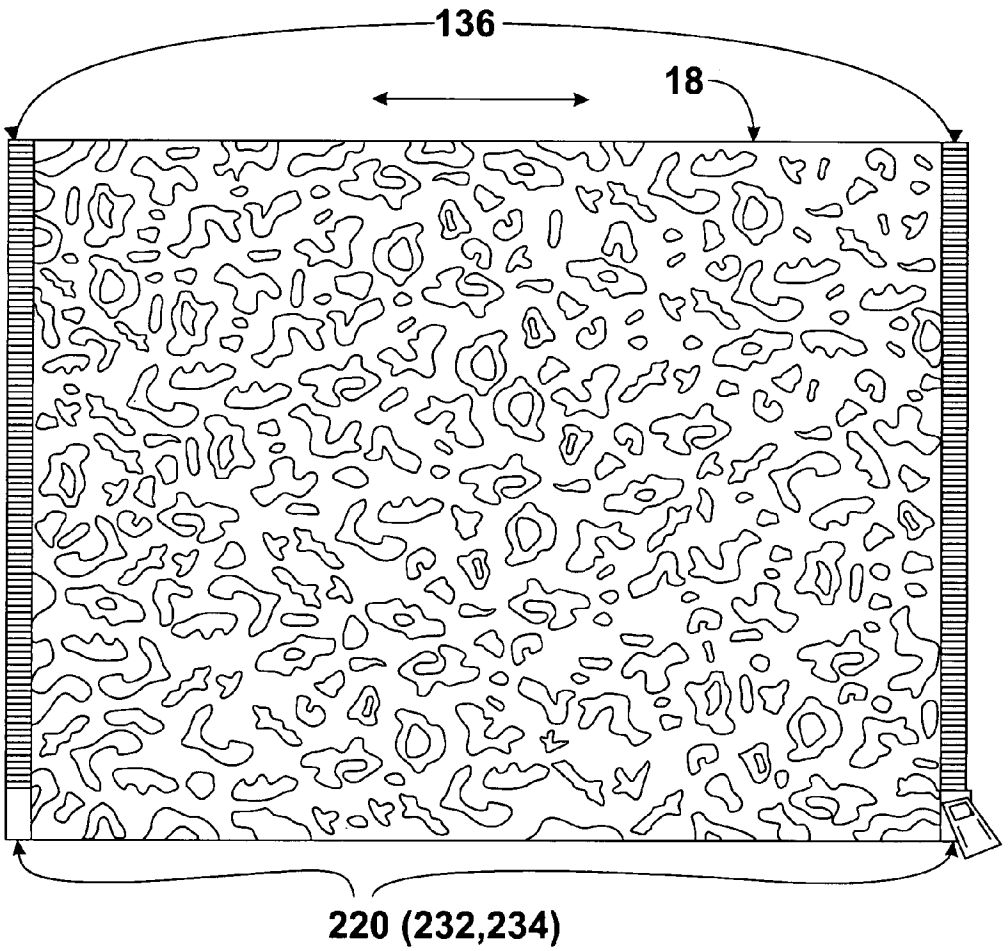
FIG. 5 is a diagrammatic side elevational view of the universal, readily interchangeable, and non-gaiter cover of the embodiments of the present invention identified by ARROW 5 in FIGS. 1 and 2, with a second embodiment of the fastening apparatus being a decorative zipper.

The second embodiment of the apparatus 220 can best be seen in FIG. 5, which is a diagrammatic side elevational view of the universal, readily interchangeable, and non-gaiter cover of the embodiments of the present invention identified by ARROW 5 in FIGS. 1 and 2, with a second embodiment of the fastening apparatus being a decorative zipper, and as such, will be discussed with reference thereto.

The apparatus 220 includes a decorative zipper 232. The decorative zipper 232 of the apparatus 220 has a pair of cooperating decorative zipper parts 234. The pair of cooperating decorative zipper parts 234 of the decorative zipper 232 of the apparatus 220 are disposed along the free axial edges 136 of the decorative substrate 18, respectively.

(4) Third Embodiment of the Apparatus 320

The third embodiment of the apparatus 320 can best be seen in FIG. 6, which is a diagrammatic side elevational view of the universal, readily interchangeable, and non-gaiter cover of the embodiments of the present invention identified by ARROW 6 in FIGS. 1 and 2, with a third embodiment of the fastening apparatus being decorative buttons and cooperating loops, and as such, will be discussed with reference thereto.

The apparatus 320 includes decorative button parts 332 and cooperating loop parts 334. The decorative button parts 332 and the cooperating loop parts 334 of the apparatus 320 are disposed along the free axial edges 136 of the decorative substrate 18, respectively.

(5) Fourth Embodiment of the Apparatus 420

The fourth embodiment of the apparatus 420 can best be seen in FIG. 7, which is a diagrammatic side elevational view of the universal, readily interchangeable, and non-gaiter cover of the embodiments of the present invention identified by ARROW 7 in FIGS. 1 and 2, with a fourth embodiment of the fastening apparatus being decorative snaps, and as such, will be discussed with reference thereto.

The apparatus 420 includes decorative snaps 432. The decorative snaps 432 of the apparatus 420 has a pair of cooperating decorative snap parts 434. The pair of cooperating decorative snap parts 434 of the decorative snaps 432 of the apparatus 420 are disposed along the free axial edges 136 of the decorative substrate 18, respectively.

(6) Understandings

It is to be understood that since the decorative substrate 18 wraps around only the shaft 12 of the any sized and mundane boot 14 and not the foot 16 of the any sized and mundane boot 14, a need for a stirrup or the like is eliminated.

It is to be further understood that since the decorative substrate 18 is elastic only horizontally, there is no need for the decorative substrate 18 to extend to the very top of the shaft 12 of the any sized and mundane boot 14.

C. Impressions

It will be understood that each of the elements described above or two or more together may also find a useful application in other types of constructions differing from the types described above.

While the embodiments of the present invention have been illustrated and described as embodied in a universal, readily interchangeable, and non-gaiter cover for wrapping around and decorating only the shaft of an any sized and mundane boot and not the foot of the any sized and mundane boot, nevertheless, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. Footwear, comprising:

a) a boot having a shaft and a foot;

b) a substrate; and c) means for readily interchangeably maintaining said substrate around only said shaft of said boot and not said foot of said boot so as to at least eliminate potential damage to said substrate caused by normal flexure of said foot of said boot;

wherein said substrate readily interchangeably wraps around only said shaft of said boot and not said foot of said boot so as to at least eliminate potential damage to said substrate caused by normal flexure of said foot of said boot; wherein said substrate has free axial edges from after manufacture of said footwear to before donning said footwear; wherein said means is disposed along said free axial edges of said substrate, respectively; wherein said free edges of said substrate comprising said means are not engaged with said boot by way of said means of maintaining; wherein said shaft of said boot has an upper edge; and wherein said substrate does not extend to said upper edge of said shaft of said boot wherein said substrate is a unidirectional elastic substrate; and wherein said unidirectional elastic substrate of said substrate is elastic only horizontally and not vertically so as to allow horizontal stretching to fit smoothly and conformingly around only said shaft of said boot; wherein said means includes hook and loop fasteners; wherein said hook and loop fasteners of said means has a pair of cooperating hook and loop parts; and wherein said pair of cooperating hook and loop parts of said hook and loop fasteners of said means are disposed along said free axial edges of said substrate, respectively.

2. Footwear, comprising:

a) a boot having a shaft and a foot;

b) a substrate; and c) means for readily interchangeably maintaining said substrate around only said shaft of said boot and not said foot of said boot so as to at least eliminate potential damage to said substrate caused by normal flexure of said foot of said boot;

wherein said substrate readily interchangeably wraps around only said shaft of said boot and not said foot of said boot so as to at least eliminate potential damage to said substrate caused by normal flexure of said foot of said boot; wherein said substrate has free axial edges from after manufacture of said footwear to before donning said footwear; wherein said means is disposed along said free axial edges of said substrate, respectively; wherein said free edges of said substrate comprising said means are not engaged with said boot by way of said means of maintaining; wherein said shaft of said boot has an upper edge; and wherein said substrate does not extend to said upper edge of said shaft of said boot wherein said substrate is a unidirectional elastic substrate; and wherein said unidirectional elastic substrate of said substrate is elastic only horizontally and not vertically so as to allow horizontal stretching to fit smoothly and conformingly around only said shaft of said boot; wherein said means includes a zipper; wherein said zipper of said means has a pair of cooperating zipper parts; and wherein said pair of cooperating zipper parts of said zipper of said means are disposed along said free axial edges of said substrate, respectively.

3. Footwear, comprising:

a) a boot having a shaft and a foot;

b) a substrate; and c) means for readily interchangeably maintaining said substrate around only said shaft of said boot and not said foot of said boot so as to at least eliminate potential damage to said substrate caused by normal flexure of said foot of said boot;

wherein said substrate readily interchangeably wraps around only said shaft of said boot and not said foot of said boot so as to at least eliminate potential damage to said substrate caused by normal flexure of said foot of said boot; wherein said substrate has free axial edges from after manufacture of said footwear to before donning said footwear; wherein said means is disposed along said free axial edges of said substrate, respectively; wherein said free edges of said substrate comprising said means are not engaged with said boot by way of said means of maintaining; wherein said shaft of said boot has an upper edge; and wherein said substrate does not extend to said upper edge of said shaft of said boot wherein said substrate is a unidirectional elastic substrate; and wherein said unidirectional elastic substrate of said substrate is elastic only horizontally and not vertically so as to allow horizontal stretching to fit smoothly and conformingly around only said shaft of said boot; wherein said means includes:

a) button parts; and b) cooperating loop parts;

wherein said button parts of said means and said cooperating loop parts of said means are disposed along said free axial edges of said substrate, respectively.

4. Footwear, comprising:

a) a boot having a shaft and a foot;

b) a substrate; and c) means for readily interchangeably maintaining said substrate around only said shaft of said boot and not said foot of said boot so as to at least eliminate potential damage to said substrate caused by normal flexure of said foot of said boot;

wherein said substrate readily interchangeably wraps around only said shaft of said boot and not said foot of said boot so as to at least eliminate potential damage to said substrate caused by normal flexure of said foot of said boot; wherein said substrate has free axial edges from after manufacture of said footwear to before donning said footwear; wherein said means is disposed along said free axial edges of said substrate, respectively; wherein said free edges of said substrate comprising said means are not engaged with said boot by way of said means of maintaining; wherein said shaft of said boot has an upper edge; and wherein said substrate does not extend to said upper edge of said shaft of said boot wherein said substrate is a unidirectional elastic substrate; and wherein said unidirectional elastic substrate of said substrate is elastic only horizontally and not vertically so as to allow horizontal stretching to fit smoothly and conformingly around only said shaft of said boot; wherein said means includes snaps; wherein said snaps of said means has a pair of cooperating snap parts; and wherein said pair of cooperating snap parts of said snaps of said means are disposed along said free axial edges of said substrate, respectively.

5. The footwear as in any one of claims 1, 2, 3, and 4, wherein said unidirectional elastic substrate of said substrate is a water-repellent and unidirectional elastic substrate; and wherein said water-repellent and unidirectional elastic substrate of said unidirectional elastic and substrate of said substrate provides waterproofing when said boot is a rain boot.

6. The footwear as in any one of claims 1, 2, 3, and 4, wherein said footwear does not include a stirrup, since said substrate wraps around only said shaft of said boot and not said foot of said boot.

7. The footwear as in any one of claims 1, 2, 3, and 4, wherein said substrate has a top edge; and wherein said means does not include clasp elements at said top edge of said substrate.

* * * * *